US006207019B1

(12) United States Patent
Zwart et al.

(10) Patent No.: US 6,207,019 B1
(45) Date of Patent: Mar. 27, 2001

(54) CALENDER HOOD

(75) Inventors: Jake Zwart, Millgrove; Derek A. Twitchen, Burlington, both of (CA)

(73) Assignee: Abitibi-Price, Inc. (CA)

( * ) Notice: Subject to any disclaimer, the term of this patent is extended or adjusted under 35 U.S.C. 154(b) by 745 days.

(21) Appl. No.: 08/516,752

(22) Filed: Aug. 18, 1995

(51) Int. Cl.[7] ..... D21F 7/00; D21G 1/00

(52) U.S. Cl. ..... 162/207; 34/117; 100/331; 162/359.1; 162/375

(58) Field of Search ..... 162/206, 207, 162/359.1, 375; 34/242, 116, 117; 100/38, 93 RP, 161, 331

(56) References Cited

U.S. PATENT DOCUMENTS 3,124,504 * 3/1964 Mahoney et al. ..... 162/206
4,274,915 * 6/1981 Munhri ..... 162/206
4,427,736 * 1/1984 Beacom et al. ..... 34/116
4,653,395 * 3/1987 Verkasalo ..... 162/206
4,718,982 * 1/1988 Swenson et al. ..... 162/206
5,392,701 * 2/1995 Schiel ..... 162/206

OTHER PUBLICATIONS

MacDonald et al "PaperMaking and PaperBoard Making" McGraw–Hill, 1970, pp. 456, 460, 462, 463, 564, 565, 567, 568.*

* cited by examiner

*Primary Examiner*—Karen M. Hastings
(74) *Attorney, Agent, or Firm*—Hoffmann & Baron, LLP

(57) ABSTRACT

A calender hood for a paper machine having a dryer section and a calender section the hood extending along a portion of the paper path from the dryer section through the calender section to restrict movement of the ambient air into the region between the surface of the paper sheet and the calender hood and thereby reduce heat losses to the ambient air by the paper sheet.

13 Claims, 4 Drawing Sheets

CALENDER HOOD

FIELD OF THE INVENTION

The present invention relates to a method and apparatus for reducing heat losses from the paper sheet in a paper machine to improve calendering of the paper sheet. The invention relates in particular to a hood to reduce heat losses from the paper sheet as it travels from the dryer section through the calender section.

BACKGROUND OF THE INVENTION

Pulp products such as paper and board are manufactured commercially in large scale paper machines. Paper machines generally have a forming section, a press section, a dryer section, a calendering section (or stack) and a take-up reel. The path of the pulp stock through the paper machine from the forming section to the take-up reel is sometimes referred to herein as the paper path.

The forming section comprises endless moving forming fabrics or screens of several well known types (fourdrinier, double wire and cylinder, etc.) onto which a slurry of pulp stock is spread continuously. Water drains from the pulp stock, or is removed under suction, so that a layer of pulp (the "paper sheet") is formed on the forming fabric or screen.

The paper sheet then passes through the press section, where water is removed mechanically by squeezing the paper sheet between large rotating rolls or cylinders, and the dryer section, where the paper sheet is subjected to evaporative drying to further reduce the water content.

On leaving the dryer section, the paper sheet enters the calender section, usually consisting of one or two calender stacks employing hard steel and/or "soft covered" steel rolls in which the steel roll has been coated with plastic or other elastic material to provide a softer surface.

Calendering decreases thickness, increases the density of the paper and improves the paper finish. The paper sheet is then wound into rolls on the take-up reel.

Conventionally, calendering is performed on a vertical stack of rolls or cylinders, generally made of cast iron and having a hardened smooth surface or, in the case of "soft" nip calendering, one hard roll and one soft covered roll. The rolls extend across the width of the paper machine, which can be up to about 10 meters on modern machines. As the paper sheet passes between two adjacent rolls, the weight of the rolls presses on the paper sheet, changing the thickness, density and finish of the paper sheet. The pressure exerted by the calender rolls can, in some calender stacks, be adjusted and additional load added to some rolls to increase the pressure exerted by the rolls, or the weight relieved for some rolls to reduce the pressure exerted by the rolls.

This calendering process continues as the paper sheet proceeds through additional nips between adjacent rolls. On modern machines, the hard nip calender stack generally comprises four to six rolls, resulting in three to five nips between adjacent rolls. Older paper machines generally include a larger number of calender rolls, often nine. Soft calenders generally have two nips, each nip with one hard and one soft covered roll.

The finish imparted by the calendering process is dependent on a number of factors. The most important of these is the calender type (hard or soft) and then the calender load (the pressure exerted by the calender rolls on the paper sheet), however, high calender loads may create weaknesses in the paper sheet. The temperature of the paper sheet is also an important factor and heated calender rolls have been used for many years to improve the paper finish. Finally, other factors include the calender configuration (including the roll diameter), the speed of the paper sheet through the calender, the pulp type and the moisture content of the paper sheet.

Calender rolls were originally heated using steam heating through a small central bore. However, steam heating is relatively inefficient and has been largely replaced by hot water heating which is the most widely used method today.

There are several practical limitations to the use of heated calender rolls. First, a ten degree rise in the calender hot water temperature only results in about a three degree rise in the temperature of the paper sheet. Second, at water temperatures above 100° C., the hot water system must be pressurized to maintain the water in the liquid phase. At typical hot water temperatures of 125° C., the costs of pressurizing the system are acceptable. However, as the temperature rises further, the cost of building and maintaining a pressurized hot water system becomes unacceptably high. Third, at high temperatures, the surface of the calender roll may be distorted through the "oxbow" effect which results in a non-uniform paper thickness across the machine width.

The temperature of the paper sheet reaches a maximum in the dryer section of the paper machine, where heat is applied, and decreases thereafter due to convection and thermal losses to the ambient air.

The heat losses, and consequent temperature drop, in the paper sheet can be dramatic and the temperature drop, for example, between the dryer section and the calender section, or between two calender stacks, can be more than 20° C., high enough that it is difficult to replace the heat through heating of the calender rolls. For example, on a high speed newsprint machine, temperature readings for the paper sheet were recorded as follows: from the dryer section to the first calender stack, the temperature of the paper sheet dropped from 85° C. to 60° C. The calender rolls in the first calender stack were heated and the temperature of the paper sheet on exiting the first calender stack was 68° C. The temperature drop for the paper sheet from the first calender stack to the second calender stack was from 68° C. to 48° C. The calender rolls in the second calender stack were heated and the sheet exited the second calender stack at a temperature of 60° C.

The actual temperature changes in the paper sheet recorded in any given paper machine will depend on many variables such as the paper sheet composition, speed, thickness and the distance the paper sheet travels between the dryer and the calender section or between the calender stacks, and the ambient air temperature.

SUMMARY OF THE INVENTION

It is an object of this invention to reduce heat loses from the paper sheet in a paper machine as the paper sheet travels from the dryer section through the calender section. More particularly, it is an object of this invention to reduce heat losses from the paper sheet by restricting movement of the ambient air into the region adjacent the paper sheet by the use of a substantially air impervious barrier as a calender hood along the paper path from the dryer section through the calender section.

One aspect of the invention is a calender hood for a paper machine having a dryer section and a calender section, the calender hood comprising a substantially air impervious barrier located near the paper sheet along at least a portion of the path of the paper sheet from the dryer section through the calender section to restrict movement of the ambient air into the region between the calender hood and the surface of the paper sheet.

Another aspect of the invention is a method of reducing heat loss from a paper sheet in a paper machine having a dryer section and a calender section, the method comprising positioning a substantially air impervious barrier as a calender hood near the paper sheet along at least a portion of the path of the paper sheet from the dryer section through the calender section to restrict movement of the ambient air into the region between the calender hood and the surface of the paper sheet.

DETAILED DESCRIPTION OF THE PREFERRED EMBODIMENTS

Figure 1:
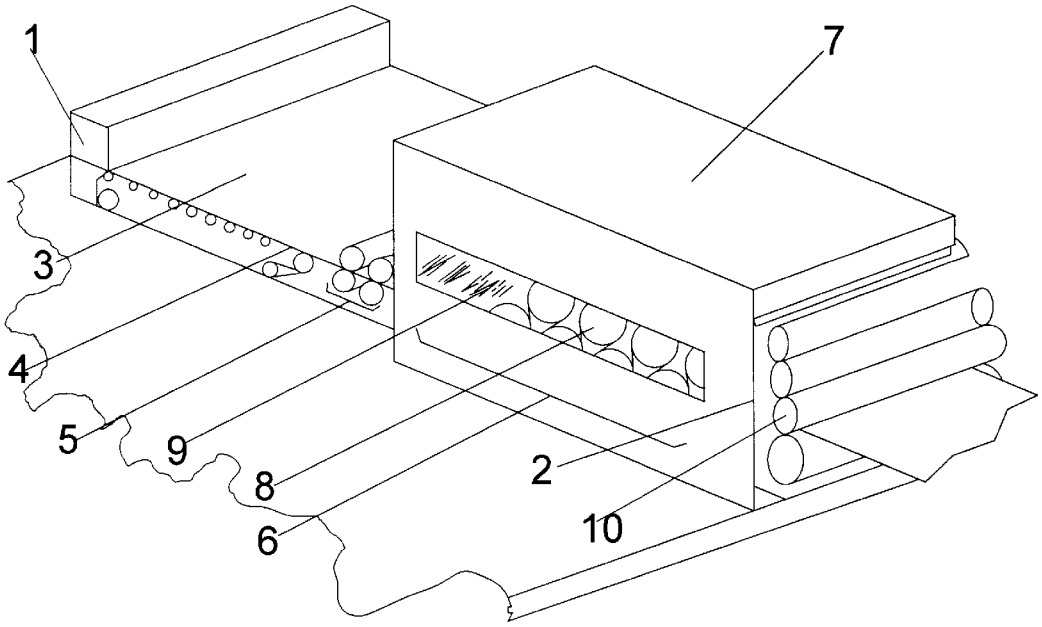
FIG. 1 is a perspective view of a paper machine.

A simplified perspective view of a paper machine is shown in FIG. 1. Referring to FIG. 1, the paper machine has a head box 1 for discharging a uniform jet of paper making stock onto the moving wire 3. Water drains from the paper stock on the wire 3, and may additionally be removed by suction, to form a continuous matted web or paper sheet 4. The paper sheet 4 continues through the press section 5 where more water is removed by a series of roll presses and the paper sheet structure is consolidated (the fibres are pressed into intimate contact).

The paper sheet 4 then enters the dryer section 6 where the remaining water is evaporated by heated rolls. A dryer hood 7 is commonly used to restrict air flow around the dryer rolls 8 and thereby retain heat. The dryer hood 7 as shown in FIG. 1 encloses the top and sides of the dryer section 6 and partially encloses the ends through which the paper sheet 4 enters and leaves the dryer section. A viewing panel 9 of thermopane windows may be constructed in one or both sides of the dryer hood 7 to allow visual inspection of the dryer section 6 without entering the dryer hood 7.

Figure 2:
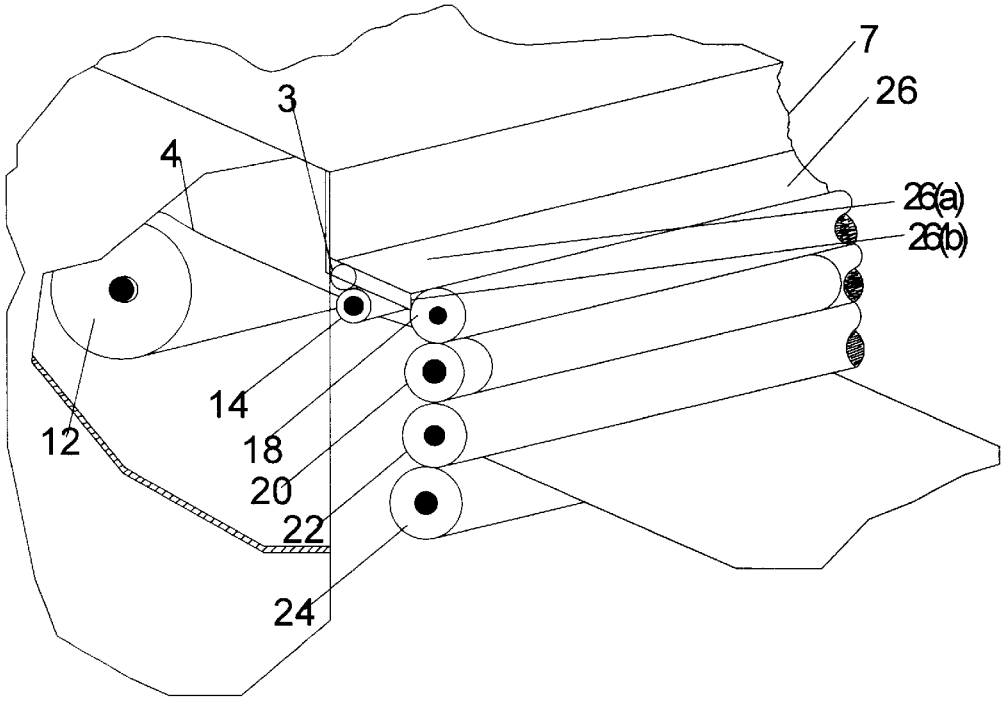
FIG. 2 is a perspective view at 2 as indicated by the arrow in FIG. 1 showing the calender stack and the adjacent portion of the dryer section.

The arrangement of the paper machine in the vicinity of the calender stack 10 in FIG. 1 at arrow 2 is shown in FIG. 2.

In FIG. 2, the paper sheet 4 leaves a sweat dryer 12, which is the last roll in the dryer section of the paper machine, and passes over a guide roll 14 and then into the calender stack 10, which is shown as comprising four calender rolls 18, 20, 22 and 24. However, it is to be understood that the present invention can be used with a calender stack comprising any number of calender rolls.

According to a first embodiment of the present invention, a calender hood 26 extends generally between the dryer hood 7 and the first calender roll 18. The calender hood 26 extends across the width of the paper sheet above the paper sheet. The calender hood 26 may consist of one or more panels. The calender hood 26 as shown in FIG. 2 consists of a generally horizontal panel 26(*a*) and a generally vertical panel 26(*b*) extending from the panel 26(*a*) downwards towards the paper sheet 4. The calender hood 26 can be anywhere from a few millimeters to several meters from the surface of the paper sheet 10. Generally it will be located between about 10 and 500 mm above the paper sheet.

In the paper machine shown in FIG. 1, the dryer section includes a dryer hood 7, and in the embodiment shown in FIG. 2, the calender hood 26 is continuous with the dryer hood 7. The dryer hood 7 is shown in a cut away to show the sweat dryer 12.

The calender hood generally restricts the movement of the air surrounding the paper machine in the mill (the ambient air) into the region between the calender hood 26 and the surface of the paper sheet 4. The calender hood 26 therefore has an insulating effect on the paper sheet 4 reducing heat losses to the ambient air through convection and thermal effects. These heat losses can result in the temperature of the paper sheet dropping by 20° C. or more between the sweat dryer 12 and the calender stack 10. The calender hood reduces these heat losses by about 40% (for example, a 12° C. temperature drop rather than a 20° C. temperature drop).

The insulating effect of the calender hood 26 increases the effectiveness of the calendering process, and the effect of any heating of the calender rolls. Further, there is a limit to the temperature increase in the paper sheet that can be achieved through heating of the calender rolls for the reasons mentioned earlier. It is far more effective to retain heat in the paper sheet than to attempt to add heat through heating of the calender rolls or otherwise.

The calender hood of the present invention can be constructed from a range of materials suitable to the mill environment including metal and plastic. The calender hood need not be completely air impervious as long as it achieves the desired effect of restricting movement of the ambient air to and from the region immediately adjacent the surface of the paper sheet 4.

Figure 3:
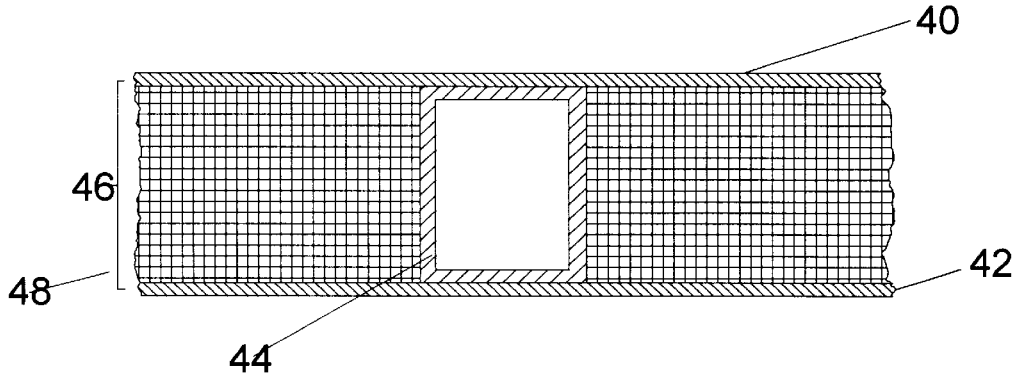
FIG. 3 is a cross-section of a section of the calender hood shown in FIG. 2 at 3.

The calender hood may also include an insulating material to reduce heat loss through the hood and condensation. FIG. 3, for example, shows a cross-section through the calender hood shown in FIG. 2 at arrow 3. The calender hood has a first aluminum skin 40 approximately 5 mm in thickness and a second aluminum skin 42 approximately 5 mm in thickness separated by spacers 44 to maintain the two aluminum skins approximately 50 mm apart. The space between the aluminum skins 46 is filled with fibreglass insulation 48.

Further, the calender hood may be heated to prevent condensation thereon. This may be done in any number of ways including electrical resistance heating of the hood itself, or by blowing heated air onto or through specially design tubes in the hood. Also, pocket ventilation air could be used to heat the hood, with the hot pocket ventilation air exhausted on the sheet side of the hood to prevent cold air from contacting the sheet. Pocket ventilation air is hot dry air introduced in the dryer section to displace the very humid condensation laden air with dry air. These and many other methods of heating the hood will be well known to those skilled in the art.

Figure 4:
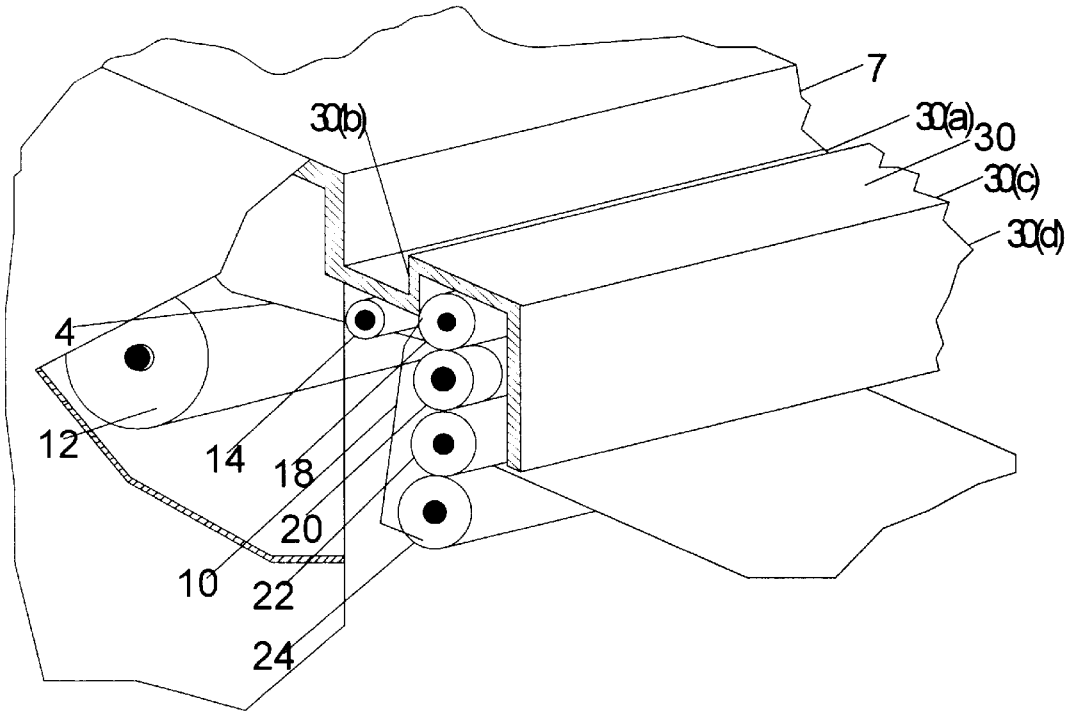
FIG. 4 is a perspective view at 2 of the paper machine as indicated by the arrow in FIG. 1 showing the calender stack and the adjacent portion of the dryer section according to a second aspect of the present invention; and, FIG. 5 is a perspective view at 2 of the paper machine as indicated by the arrow in FIG. 1 showing the calender stack and the adjacent portion of the dryer section according to a third aspect of the present invention.

FIG. 4 shows a second embodiment of the present invention, in which a calender hood 30 extends from the sweat roll 12 at the end of the dryer section over the calender stack 10 so as to be proximate the paper sheet 4 along the paper path from the sweat roll 12 through the calender stack 10.

The calender hood 30 comprises four adjoining panels 30(*a*), (*b*), (*c*) and (*d*) which extend along the paper path from the sweat dryer 12 through the calender stack 10. As can be seen, panel 30(*a*) is positioned between the sweat dryer 12 and the calender stack 10, and is similar to the horizontal panel of the calender hood shown in FIG. 1. As can be seen, panels 30(*b*), (*c*) and (*d*) surround the upper calender roll 18, and panel 30(*d*) extends proximate to the point where the paper sheet 4 exits the calender stack 10. In this embodiment, panels 30(*a*), (*b*), (*c*) and (*d*) are joined to the adjacent panel so as to form a continuous structure. Also, panel 30(*a*) is continuous with dryer hood 7 so as to minimize heat loss from the paper sheet 4 as it travels through the vicinity of the calender stack.

Figure 5:
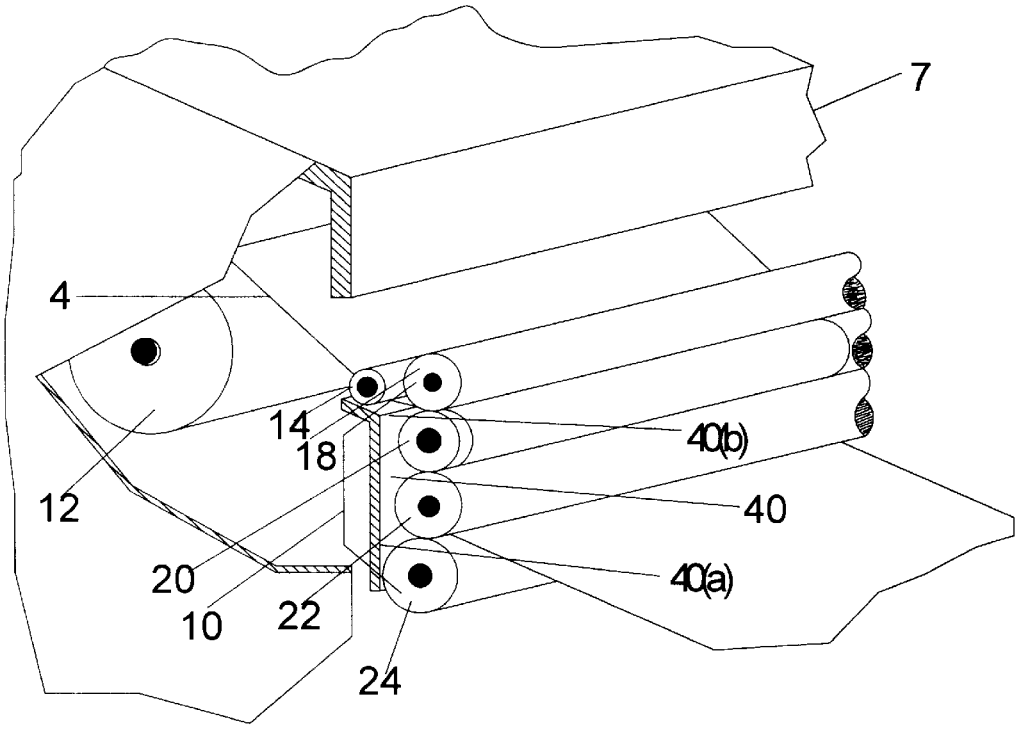

FIG. 5 shows a third embodiment of the present invention, in which a calender hood 40 comprises two portions 40(*a*) and 40(*b*). The portions 40(*a*) and 40(*b*) form a generally L-shaped structure. In this embodiment, the calender hood 40 is placed below the path of the paper sheet 4. While such a placement of the calender hood serves to reduce the heat loss from the paper sheet, it has been observed that the ambient temperature above the paper sheet is generally lower than the ambient temperature below the paper sheet, and hence greater efficiency can be achieved by placing the calender hood above the sheet. Further, placement of the calender hood below the path of the paper sheet 4 restricts access to the space between the dryer section and the calender stack 10, which is generally undesirable.

A hood could of course be placed both above and below the paper sheet. However, as mentioned, the greatest efficiencies at the lowest capital cost arise from the placement of the hood above the paper sheet. Further, in operation, it is desirable that mill workers have access to the space between the sweat dryer and the calender stack.

As will be evident to those skilled in the art, calender hoods according to the present invention may have a variety of configurations and all such configurations are intended to be within the scope of the appended claims.

We claim:

1. In a paper machine having a dryer section and a calender section for a paper sheet to pass therebetween during manufacture, a calender hood comprising a substantially air impervious barrier located near the paper sheet, continuously and uninterruptedly extending from the dryer section to the calender section and containing at least a portion of the calender section to restrict movement of the ambient air into the region between the calender hood and a surface of the paper sheet during passage of said paper sheet from the drying section to the calender section.

2. A calender hood as claimed in claim 1, wherein the calender hood extends across the width of the paper sheet.

3. A calender hood as claimed in claim 2, wherein the calender hood extends from the dryer section over the calender section to a position proximate the point where the paper sheet leaves the calender section.

4. A calender hood as in claim 1, wherein the dryer section includes a dryer hood and the calender hood extends generally from the dryer hood to the calender section.

5. A calender hood as claimed in claim 4, wherein the calender hood is attached to the dryer hood.

6. A calender hood as claimed in claim 2, wherein the calender hood comprises a first portion extending generally between the dryer section and calender section, the first portion spaced vertically upwards from the paper sheet, and a second portion extending over and spaced from the calender section, the second portion extending from the first portion to a position proximate the exit of the paper sheet from the calender section.

7. A calender hood as claimed in claim 1, wherein the calender stack comprises a plurality of vertically disposed rolls and wherein the calender hood comprises a generally horizontal first portion and a generally vertical second portion, the second portion being generally parallel to the calender stack and the first and second portions being joined to form a generally L-shaped structure.

8. A calender hood as claimed in claim 1, wherein the calender hood further comprises a layer of insulating material.

9. A method of reducing heat loss from a paper sheet in a paper machine having a dryer section and a calender section for a paper sheet to pass therebetween during manufacture, the method comprising positioning a substantially air impervious barrier as a calender hood near the paper sheet, continuously and uninterruptedly extending from the dryer section to the calender section and containing at least a portion of the calender section to restrict movement of the ambient air into the region between the calender hood and a surface of the paper sheet during passage of said paper sheet between said dryer section and said calender section.

10. A method as claimed in claim 9, wherein the calender hood extends across the width of the paper sheet.

11. A method as claimed in claim 10, wherein the calender hood is spaced vertically upwards from the paper sheet.

12. A method as claimed in claim 11, wherein the calender hood extends from the dryer section over and spaced from the calender section to a position proximate the point where the paper sheet leaves the calender section.

13. A method as claimed in claim 9, wherein the calender hood further comprises a layer of insulating material.

* * * * *